US007037420B2

(12) United States Patent
Yoshida et al.

(10) Patent No.: US 7,037,420 B2
(45) Date of Patent: May 2, 2006

(54) ANODIC OXIDATION METHOD AND TREATMENT APPARATUS THEREOF

(75) Inventors: Hideo Yoshida, 5-33-6, Kumegawa-machi, Higashimurayama-shi, Tokyo (JP); Kentaro Abe, Higashimurayama (JP); Masato Sone, Koganei (JP)

(73) Assignee: Hideo Yoshida, Tokyo (JP)

( * ) Notice: Subject to any disclaimer, the term of this patent is extended or adjusted under 35 U.S.C. 154(b) by 279 days.

(21) Appl. No.: 10/466,983

(22) PCT Filed: May 24, 2002

(86) PCT No.: PCT/IB02/01806

§ 371 (c)(1),
(2), (4) Date: Jun. 4, 2004

(87) PCT Pub. No.: WO03/054253

PCT Pub. Date: Jul. 3, 2003

(65) Prior Publication Data

US 2004/0206632 A1 Oct. 21, 2004

(30) Foreign Application Priority Data

Dec. 20, 2001 (JP) ..... 2001-387780

(51) Int. Cl.
*C25D 11/04* (2006.01)
*C25D 21/16* (2006.01)

(52) U.S. Cl. ..... 205/88; 205/98; 205/101; 205/324; 205/333

(58) Field of Classification Search ..... 205/88, 205/98, 101, 324, 333
See application file for complete search history.

(56) References Cited

U.S. PATENT DOCUMENTS 4,589,972 A * 5/1986 Pompea et al. ..... 205/205

FOREIGN PATENT DOCUMENTS

JP 9-176892 7/1997

OTHER PUBLICATIONS

IBM Technical Disclosure Bulletin NB8910439, Oct. 1, 1989.*

* cited by examiner

*Primary Examiner*—Roy King
*Assistant Examiner*—William T. Leader
(74) *Attorney, Agent, or Firm*—Jordan and Hamburg LLP

(57) ABSTRACT

The present invention relates to an anodic oxidation method and a treatment apparatus thereof which is suitable, for example, for generation of an oxide film and electropolishing of aluminum, capable of generating an oxide film at a low cost and rapidly by eliminating the use of electrolytic solution having a strong acid property and using a carbonated water as the electrolytic solution, capable of improving the oxide film generating operation and rationalizing the water discharging treatment, capable of preventing increase in temperature of the electrolytic solution without a need of a special equipment, capable of generating an oxide film in a stable manner and obtaining a good oxide film by eliminating the generation of oxide in the vicinity of an object to be treated, and capable of rationalization of the oxide film generating treatment and enhancing the productivity by using supercritical carbon dioxide. An object (3) to be treated is electrolyzed as an anode in an electrolytic solution. An oxide film is generated on the surface of the object (3). A pressurized carbon dioxide is dissolved in a predetermined quantity of water (7). An oxide film is generated by serving a carbonated water of a predetermined acid concentration as an electrolytic solution.

10 Claims, 3 Drawing Sheets

ANODIC OXIDATION METHOD AND TREATMENT APPARATUS THEREOF

TECHNICAL FIELD

The present invention relates to an anodic oxidation method and a treatment apparatus thereof which is suitable, for example, for generation of an oxide film and electropolishing of aluminum, capable of generating an oxide film at a low cost and rapidly by eliminating the use of electrolytic solution having a strong acid property and using a carbonated water as the electrolytic solution, capable of improving the oxide film generating operation and rationalizing the water discharging treatment, capable of preventing increase in temperature of the electrolytic solution without a need of a special equipment, capable of generating an oxide film in a stable manner and obtaining a good oxide film by eliminating the generation of oxygen in the vicinity of an object to be treated, and capable of rationalization of the oxide film generating treatment and enhancing the productivity by using supercritical carbon dioxide.

BACKGROUND ART

The so-called "alumite (registered trademark) method" is known as disclosed by Japanese Patent Application Laid-Open Publication No. H09-176892, in which an oxide film of a predetermined thickness is artificially generated on a base surface of aluminum, for example. According to this method, an electrolytic solution having a strong acid property such as sulfuric acid and oxalic acid is received in an electrolytic vessel, an aluminum-made object to be treated is received in the electrolytic solution, and an oxide film is formed on the base surface of the aluminum by oxidation reaction with the electrolytic solution serving the object as an anode.

However, this conventional oxide film generating method has such problems that an electrolytic solution having a strong acid property such as sulfuric acid and oxalic acid is required, a special water discharging equipment is required for discharging the electrolytic solution, thus increasing the production cost and equipment cost, and operation is obliged to be conducted under such a circumstance that a toxic gas is generated.

Moreover, in case an oxide film having a high degree of hardness is to be generated, the temperature of the electrolytic vessel must be set to low, and in order to prevent increased in temperature due to heat radiation at the time of growth of the oxide film, a cooling equipment and its cooling operation are required. Thus, the production cost and the equipment cost are increased, and productivity is bad.

On the other hand, the above-mentioned oxide film comprises a porous bulk layer, and a barrier layer composed of an amorphous alumina ($Al_2O_3$). Of those components, the bulk layer on the outer surface side has a plurality of fine holes formed therein. By infiltrating dye in those fine holes, those areas are dyeable. After dyed, sealing treatment for sealing the holes is carried out, so that the surface of the oxide film is enhanced in corrosion resistance and stain-proof property.

However, the above-mentioned sealing treatment has such problems that an additional treatment vessel is separately required from the anodic oxidation treatment vessel, an object to be treated must be shifted to another vessel after the anodic oxidation is carried out, a pressurized water vapor must be supplied to the treatment vessel or the water received in the treatment vessel must be heated to about 100 degrees C., and a sealing agent such as nickel acetate must be applied thereto, thereby the equipment cost is increased and the process becomes complicated.

It is, therefore, a main object of the present invention to provided, in order to solve the above-mentioned problems, an anodic oxidation method and a treatment apparatus thereof which is suitable, for example, for generation of an oxide film and electropolishing of aluminum, capable of generating an oxide film at a low cost and rapidly eliminating the use of electrolytic solution having a strong acid property and using a carbonated water as the electrolytic solution, and capable of improving the oxide film generating operation and rationalizing the water discharging treatment.

Another object of the present invention is to provide an anodic oxidation method and a treatment apparatus thereof which is capable of preventing increase in temperature of the electrolytic solution without a need of a special equipment, capable of generating an oxide film in a stable manner and obtaining a good oxide film by eliminating the generation of oxygen in the vicinity of an object to be treated.

A further object of the present invention is to provide an anodic oxidation method and a treatment apparatus thereof which is capable of rationalization of the oxide film generating treatment and enhancing the productivity by using supercritical carbon dioxide.

DISCLOSURE OF THE INVENTION

According to the present invention, there is provided an anodic oxidation method for electrolyzing an object to be treated in an electrolytic solution as an anode and generating an oxide film on a surface of the object, wherein the method comprising dissolving a pressurized carbon dioxide in a predetermined quantity of water and generating an oxide film serving a carbonated water of a predetermined acid concentration as an electrolytic solution. Accordingly, production cost can be reduced and operating environment can be improved by eliminating a need of the use of the electrolytic solution having a strong acid property such as sulfuric acid and oxalic acid which is needed in the conventional method. Water can be discharged without a need of a special water discharging treatment equipment, the equipment cost can be reduced and the environmental pollution can be prevented.

According to an anodic oxidation method of the present invention, air bubbles of the carbonated water are contacted with oxygen in the vicinity of the object so as to move the oxygen. By virtue of this arrangement, the generation of an oxide film can be prevented from being adversely affected by the oxygen, an oxide film can be generated in a stable manner and a good oxide film can be obtained.

According to an anodic oxidation method of the present invention, heat of the electrolytic solution is released to the outside by means of carbon dioxide bubbles of the carbonated water. Owing to this feature, increase in temperature of the electrolytic solution caused by the growth of oxide film can be prevented without a need of a provision of the conventional special cooling means. Thus, an oxide film of good quality can be obtained.

According to an anodic oxidation method of the present invention, the carbonated water is agitated to normally generate carbon dioxide bubbles. Owing to this feature, oxygen generated in the vicinity of the object to be treated can be eliminated and increase in temperature caused by the growth of oxide film can be prevented.

According to an anodic oxidation method of the present invention, degreasing treatment and oxide film generating treatment are carried out one after another or at the same time with respect to the object. Owing to this feature, a part of the treatment process and the process for generating an oxide film can be carried out rationally and productivity can be enhanced.

According to an anodic oxidation method of the present invention, the oxide film is generated in a hermetically closed and pressurized space. Owing to this feature, carbon dioxide can be prevented from flowing out, carbon dioxide can easily be recollected and re-utilized, and the enhancement of acid concentration of the carbonated water can be promoted.

According to an anodic oxidation method of the present invention, generation of the oxide film and hole sealing treatment of the film are carried out simultaneously. Owing to this feature, those treatment processes can be rationalized so that the trouble for carrying out those treatment processes separately can be eliminated. Moreover, there can be eliminated a need of providing a treatment vessel and an equipment annexed thereto.

According to an anodic oxidation method of the present invention, supercritical carbon dioxide is dissolved in water and an oxide film is generated using a carbonated water of a predetermined acid concentration as electrolytic solution. Owing to this feature, the degreasing treatment and the oxide film generating treatment of the object, the hole sealing treatment and the cleaning treatment can be carried out in a single treatment vessel. Thus, rationalization and enhancement of productivity can be achieved.

According to an anodic oxidation method of the present invention, after generation of an anodic oxide film, the electrolytic solution is reduced in pressure and discharged. Owing to this feature, the acid concentration of the used electrolytic solution can be reduced. Thus, an easy and safe water discharge can be realized without a need of a special water discharging treatment equipment. At the same time, environmental pollution can be prevented.

According to an anodic oxidation method of the present invention, after generation of an anodic oxide film, the electrolytic solution is reduced in pressure and heated to be separated into water and carbon dioxide so as to be discharged or reutilized. Owing to this feature, an easy and safe discharge of the electrolytic solution can be realized, and the separated water and carbon dioxide can be re-utilized effectively.

According to another aspect of the present invention, there is provided an anodic oxidation treatment apparatus in which an object to be treated is placed in electrolytic solution received in an electrolytic vessel, and the object is electrolyzed as an anode to generate an oxide film on a surface of the object, wherein water and a pressurized carbon dioxide are introduced into the electrolytic vessel, a pressurized carbon dioxide is dissolved in the water to generate a carbonated water of a predetermined acid concentration, and an oxide film is generated using the carbonated water as an electrolytic solution. Owing to this feature, by dissolving the supercritical carbon dioxide in water, the degreasing treatment and the oxide film generating treatment of the object, the hole sealing treatment and the cleaning treatment can be carried out in a single treatment vessel. Thus, rationalization and enhancement of productivity can be achieved.

The above objects, features and advantages of the present invention will become more manifest from the following detailed description with reference to the accompanying drawings.

BEST MODE FOR CARRYING OUT THE INVENTION

Figure 1:
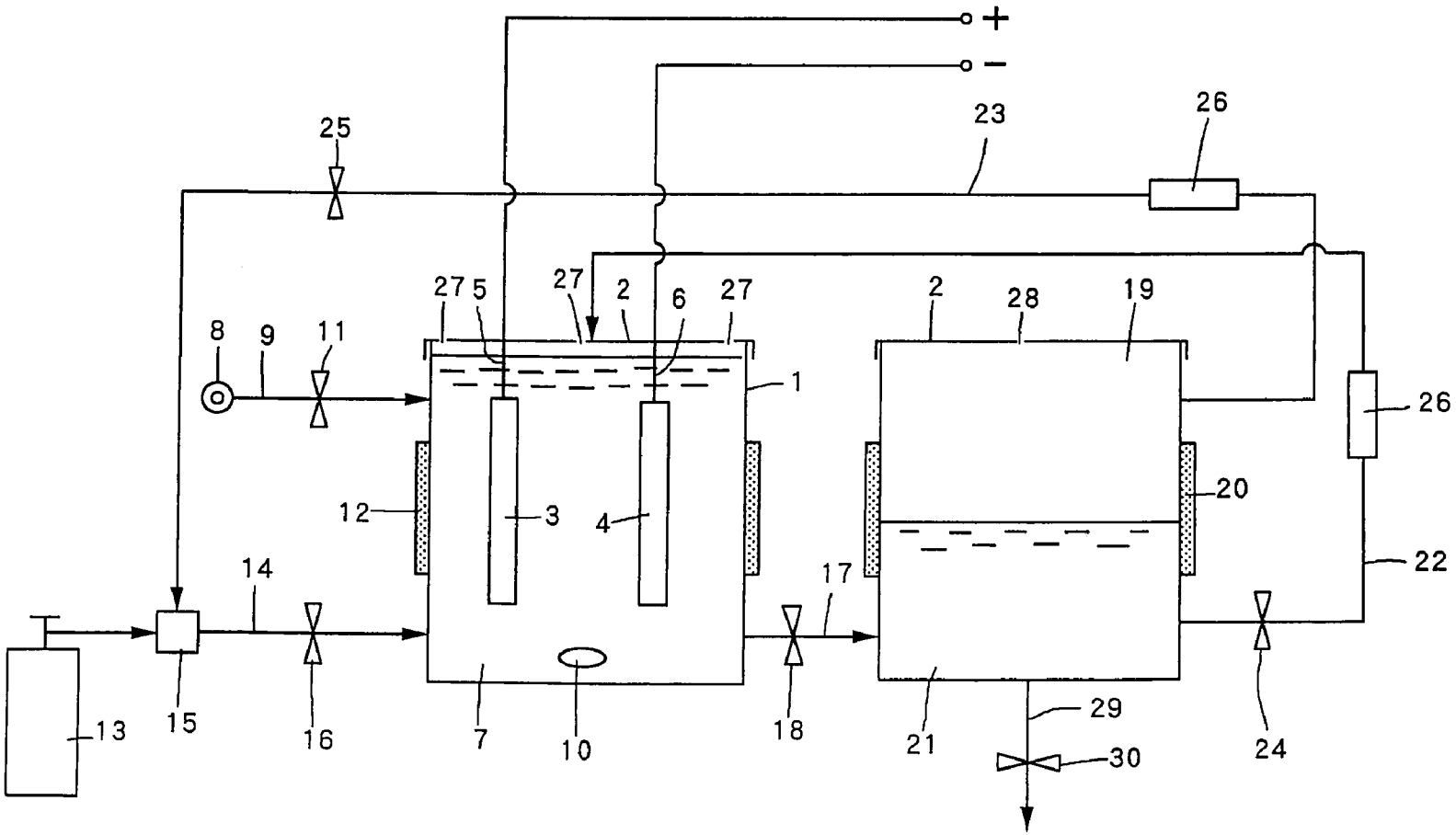
FIG. 1 is an explanatory view showing one embodiment of the present invention in which the present invention is applied to an anodic oxidation treatment of an aluminum product.

The illustrated embodiment of the present invention will be described hereinafter, in which the present invention is applied to anodic oxidation method of aluminum or its alloy as an object to be treated. In FIG. 1, reference numeral 1 denotes a stainless steel-made electrolytic vessel with a bottom. Lining of vinyl chloride or the like is applied to the inner surface of the electrolytic vessel 1. A cover member 2 is easily removably mounted on an upper opening part thereof.

An aluminum-made object 3 to be treated as an object on which an anodic oxide film is generated and a cathode material 4 such as a lead plate are hung within the electrolytic vessel 1 through hooks 5, 6 such that they can be inserted in and removed from the vessel 1. An anode and a cathode of a power source apparatus are connected to them.

Water 7 such as service water, pure water and the like as a material for generating an electrolytic solution is received in the electrolytic vessel 1, and a feed water pipe 9 communicated with a feed water source 8 is connected to its upper peripheral surface.

In the illustration, reference numeral 10 denotes an agitator such as a stirrer received in the bottom part of the electrolytic vessel 1; 11, a stop valve inserted in the feed water pipe 9; and 12, a heater mounted on a peripheral surface of the electrolytic vessel 1, respectively. This heater 12 can heat the water 7 to a predetermined temperature, 30 to 40 degrees C. in this embodiment. In this case, the warm water heated to the above-mentioned temperature may be supplied to the electrolytic vessel 1.

A gas container 13, which contains a safe and stable pressurized liquid or pressurized gas such as, for example, carbon dioxide, is installed at an outer part of the electrolytic vessel 1 as a material for generating an electrolytic solution. A gas conduit 14 for such carbon dioxide is connected to a lower peripheral surface of the electrolytic vessel 1 through a compression pump 15 and a stop valve 16.

The compression pump 15 can pressurized the carbon dioxide to a predetermined pressure, from atmospheric pressure or higher to a subcritical or supper critical pressure (7.4 MPa) or higher in this embodiment. The compression pump 15 is adapted to supply the carbon dioxide into the electrolytic vessel 1 so that the carbon dioxide is dissolved in the water 7 to generate a carbonated ($H_2$ $CO_3$) water as an electrolytic water.

A communication pipe 17 is connected to a lower part of the electrolytic vessel 1. A stop valve 18 is inserted in this pipe 17. A downstream side end part of the communication pipe 17 is connected to a storage tank 19.

The storage tank 19 is constructed in a substantially same manner and same capacity as the electrolytic vessel 1. A heater 20 is mounted on a peripheral surface of the storage tank 19 and adapted to heat the storage solution received in the tank 19 to a predetermined temperature.

In this embodiment, the storage solution 21 is heated to approximately 50 degrees C. so that the carbonated water as a main composition of the storage solution 21 can be decomposed into water and carbon dioxide.

One ends of return pipes 22, 23 are connected to upper and lower peripheral surfaces of the storage tank 19, respectively and the other ends are connected to the electrolytic vessel 1 and the compression pump 15, respectively. Owing to this arrangement, the decomposed water and carbon dioxide can be returned to the electrolytic vessel 1 and the compression pump 15, respectively.

In the illustration, reference numeral 24, 25 denote stop valves which are inserted in the return pipes 22, 23, respectively, and reference numeral 26 denote filters or ion exchange resins which are inserted in the return pipes 22, 23, respectively. Similarly, reference numeral 27, 28 denote air vents formed in the cover members 2, 2.

A discharge pipe 29 is connected to a lower part of the storage tank 19. A downstream side end part of the discharge pipe 29 is communicated with a drainage. Reference numeral 30 denotes a stop valve inserted in the discharge pipe 29.

The anodic oxidation method and the treatment apparatus thereof thus constructed require the electrolytic vessel 1 which can be opened and closed, the feed water source 8 which can supply the water 7 to the electrolytic vessel 1, the gas container 13 which can supply a liquid-state or gas-state liquid (liquid carbon dioxide having a high concentration) to the electrolytic vessel 1, and the storage tank 19 which can temporarily store a treatment solution after the generating treatment of the anodic oxide film.

That is, the water 7 and carbon dioxide, which are inexpensive and safe, are used instead of the use of the conventional electrolytic solution having a strong acid property caused by sulfuric acid and oxalic acid. By doing so, the generating cost can be reduced, the operating environment under the generation of toxic gas can be improved, and the safety of operation can be obtained.

Moreover, the use of the electrolytic solution having a strong acid property is eliminated. By doing so, no special water discharging equipment as the conventional neutralizing equipment is required, and the equipment cost can be reduced.

Moreover, the electrolytic solution of a carbonated water is normally agitated by the agitator 10. By doing so, a large amount of fine air bubble is generated in the electrolytic solution, and movement of this large amount of air bubble enhances the heat radiation of the vessel 1 so that the vessel 1 is prevented from increasing in temperature.

Accordingly, increase in temperature of the electrolytic solution caused, for example, by the growth of oxide film can be prevented, and by maintaining the constant temperature state, the generation of oxide film can be stabilized and a good oxide film can be obtained. On the other hand, the cooling means, which would otherwise be required, can be eliminated or the performance of such cooling means can be reduced.

Moreover, the treatment solution after the anodic oxidation treatment is, as later described, decomposed into water and carbon dioxide in the storage tank 19, and the decomposed water and carbon dioxide are returned to the electrolytic vessel 1 and the compression pump 15 so that they can be re-utilized. Accordingly, effective utilization and reduction of consumption thereof can be achieved.

Next, in case the object 3 is to be subjected to anodic oxidation treatment with the use of the above-mentioned treatment apparatus, the object 3 is preliminarily subjected to prior treatment. After subjecting the object 3 to degreasing treatment and etching or chemical polishing or electropolishing treatment, or satin finishing treatment, the object 3 is received in the electrolytic vessel 1 connected to the anode of the power source apparatus.

Thereafter, the cover member 2 is mounted, the water 7 is supplied to the electrolytic vessel 1 from the feed water source 8, and the object 3 is dipped in the water 7.

After a predetermined quantity of water 7 is supplied to the electrolytic vessel 1, carbon dioxide is supplied to the electrolytic vessel 1 from the gas container 7. The carbon dioxide is then pressurized to have a predetermined pressure which is atmospheric pressure or higher in this embodiment, at the compression pump 15, and the water 7 is heated to 30 to 40 degrees C. through the heater 12.

Before or after the above-mentioned treatment, the agitator 10 is actuated to agitate the electrolytic solution so that the temperature distribution and concentration distribution are uniformed.

By doing so, the carbon dioxide is vigorously ascended in the form of bubbling in the water contained in the electrolytic vessel 1 with the help of agitating effect of the agitator 10 and dissolved in the water 7 to generate carbonic acid ($H_2CO_3$) so that the water 7 is oxidized.

In this case, the carbon dioxide is pressurized to the atmospheric pressure or higher and the water 7 is heated to enhance the carbon dioxide to be dissolved in the water. Accordingly, the acid concentration of the water 7 is increased to form an acid concentration (PH3 to 4) large enough to generate oxide film.

Since the acid concentration of the carbonated water in use is reduced with the passage of time, carbon dioxide should be fed timely so that a predetermined acid concentration can be maintained.

Under the above-mentioned circumstance, a positive current is supplied to the object 3. Then, the object 3 effects oxidation reaction with the oxidized electrolytic solution, so that an anodic oxide film of amorphous alumina ($Al_2O_3$) is formed on the base surface of the object 3. At that time, oxygen is generated in the vicinity of the object 3 due to electric decomposition of water. There is a fear that it prevents the generation of anodic oxide film.

However, the oxygen is collided or contacted with the carbon dioxide in the form of bubbling and moved so that the oxidation reaction is maintained. Accordingly, the anodic oxide film is grown smoothly and rapidly.

On the other hand, a carbonated water as an electrolytic solution is heated in accordance with the growth of the oxide film. There is a fear that the increase in temperature of the carbonated water prevents the generation of an oxide film having good quality.

However, in this embodiment, a large amount of fine air bubble is generated and the movement of this air bubble enhances the heat radiation of the electrolytic vessel 1. Since this prevents the temperature increase of the electrolytic vessel 1, a stable generation of oxide film and a good oxide film can be obtained.

At that time, since the cooling means, which would otherwise be required, can be eliminated or the performance of such cooling means can be reduced, the equipment cost can be reduced to that extent.

When an anodic oxide film having a sufficient thickness is obtained as a result of the anodic oxidation treatment carried out for a predetermined time, the supply of the carbon dioxide is stopped and the actuation of the agitator 10 is stopped to open the stop valve 18.

By doing so, the inside pressure of the electrolytic vessel 1 is reduced and the dissolving degree of the carbon dioxide is lowered. The treatment solution is pushed out into the storage tank 19 through the communication pipe 17. When the total quantity of the treatment solution is moved to the storage tank 19, the stop valve 18 is closed.

As a result, the storage solution 21 stored in the storage tank 19 is reduced in pressure and the dissolving degree of the carbon dioxide is lowered. Accordingly, the acid concentration is rapidly reduced thus eliminating the fear of actual adverse effect to the environment.

Then, the stop valve 28 is opened so that the storage solution 21 can be discharged directly into the drainage from the discharge pipe 27.

In case a heavy metal, for example, exists in the storage tank 19, the carbon dioxide is disappeared from the storage solution 21, so that the heavy metal is separated from the carbonated water and deposited in the tank 19.

Accordingly, the heavy metal can be recollected together with other foreign matter and oxide film through a filter (not shown) which is inserted in the discharge pipe 29. Therefore, the safety of discharging water is ensured to prevent the environmental pollution. After recollection of the heavy metal, it can be disposed as a normal waste.

On the other hand, according to the present invention, the storage solution 21 can be re-utilized. In that case, the heater 20 is heated to heat the storage solution 21 stored in the storage tank 19 to approximately 50 degrees C.

By doing so, the carbonated water of the storage solution 21 is separated into carbon dioxide and water. The carbon dioxide and water are separated into gas-liquid two layers. That is, the gaseous carbon dioxide is located at an upper position and the water is located at a lower position.

Then, the stop valves 25, 26 are opened. As a result, the separated carbon dioxide and water are moved to the electrolytic vessel 1 and the compression pump 15 through the return pipes 22, 23, respectively, so that they can be re-utilized.

At that time, the heavy metal, oxide film and foreign matter are removed from the carbon dioxide and water by the filters 26, 26 inserted in the respective return pipes 22, 23.

At that time, since carbon dioxide is completely disappeared from the storage solution 21 by the above-mentioned decomposition, the heavy metal, the oxide film, etc. are completely deposited and can, therefore, be recollected with precision.

As discussed above, according to the present invention, the anodic oxide film of the object 3 is generated by using the water 7 and carbon dioxide, which are inexpensive and safe, are used instead of the use of the conventional electrolytic solution having a strong acid property caused by sulfuric acid and oxalic acid. By doing so, the generating cost can be reduced, the operating environment under the generation of toxic gas can be improved, and the safety of operation can be obtained. Moreover, the use of the electrolytic solution having a strong acid property is eliminated. By doing so, no special water discharging equipment as the conventional neutralizing equipment is required, and the equipment cost can be reduced.

Moreover, a large amount of fine air bubble is generated in the electrolytic solution of carbonated water and movement of the air bubble enhances the heat radiation of the vessel 1 so that the temperature of the vessel 1 can be prevented from increasing. By preventing the temperature increase, the vessel 1 is prevented from increasing in temperature at the time of growth of the anodic oxide film, so that an anodic oxide film having a good quality can be generated. The cooling means, which would otherwise be required, can be eliminated or the performance of such cooling means can be reduced.

Moreover, the treatment solution after the anodic oxidation treatment is carried out is separated into water and carbon dioxide in the storage tank 19, and the separated water and carbon dioxide are returned to the electrolytic vessel 1 and the compression pump 15 so that they can be re-utilized. Accordingly, effective utilization and reduction of consumption can be achieved.

In the above-mentioned embodiment, although the preliminarily treated object 3 is received in the electrolytic vessel 1, the degreasing treatment can be carried out with respect to the object 3 in the electrolytic vessel 1 without a need of preliminary treatment.

That is, after the object 3 is received in the electrolytic vessel 1, the pressurized carbon dioxide is fed into the water 7 contained in the electrolytic vessel 1, so that the pressurized carbon dioxide is atomized and moved at a high speed to collide with the object 3. By doing so, the oil and fat adhered to the surface of the object 3 can be peeled of and degreased.

In this case, the carbon dioxide is supplied to the electrolytic vessel 1 from a lower part thereof and ascended in the form of bubbling. Accordingly, the carbon dioxide is rapidly dissolved in the water 7 and saturated to enhance the increase in dissolving degree, and with the help of the agitator 10, a uniform and precise agitating effect can be obtained, thus promoting the degreasing action.

Instead of the above-mentioned method, the water 7 is sprayed in a mist manner within the electrolytic vessel 1 and at the same time, the carbon dioxide is supplied to the electrolytic vessel 1 so as to be mixed with the water 7. By doing so, their contact surfaces are enlarged to enhance the increase in dissolving degree. Moreover, a precise agitating effect can be obtained and the degreasing action is further promoted.

Figure 2:
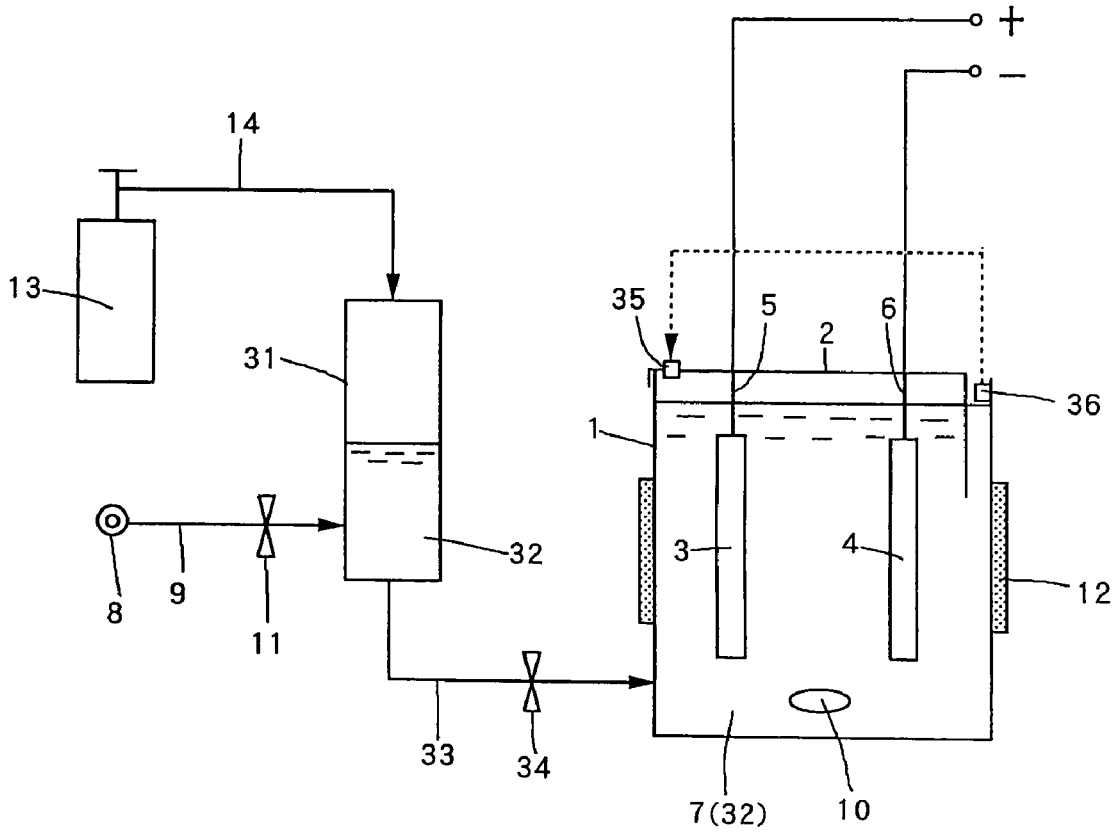
FIG. 2 is an explanatory view showing a second embodiment of the present invention in which an electrolytic solution is generated at the outside of the electrolytic solution and supplied to an electrolytic vessel.
Figure 3:
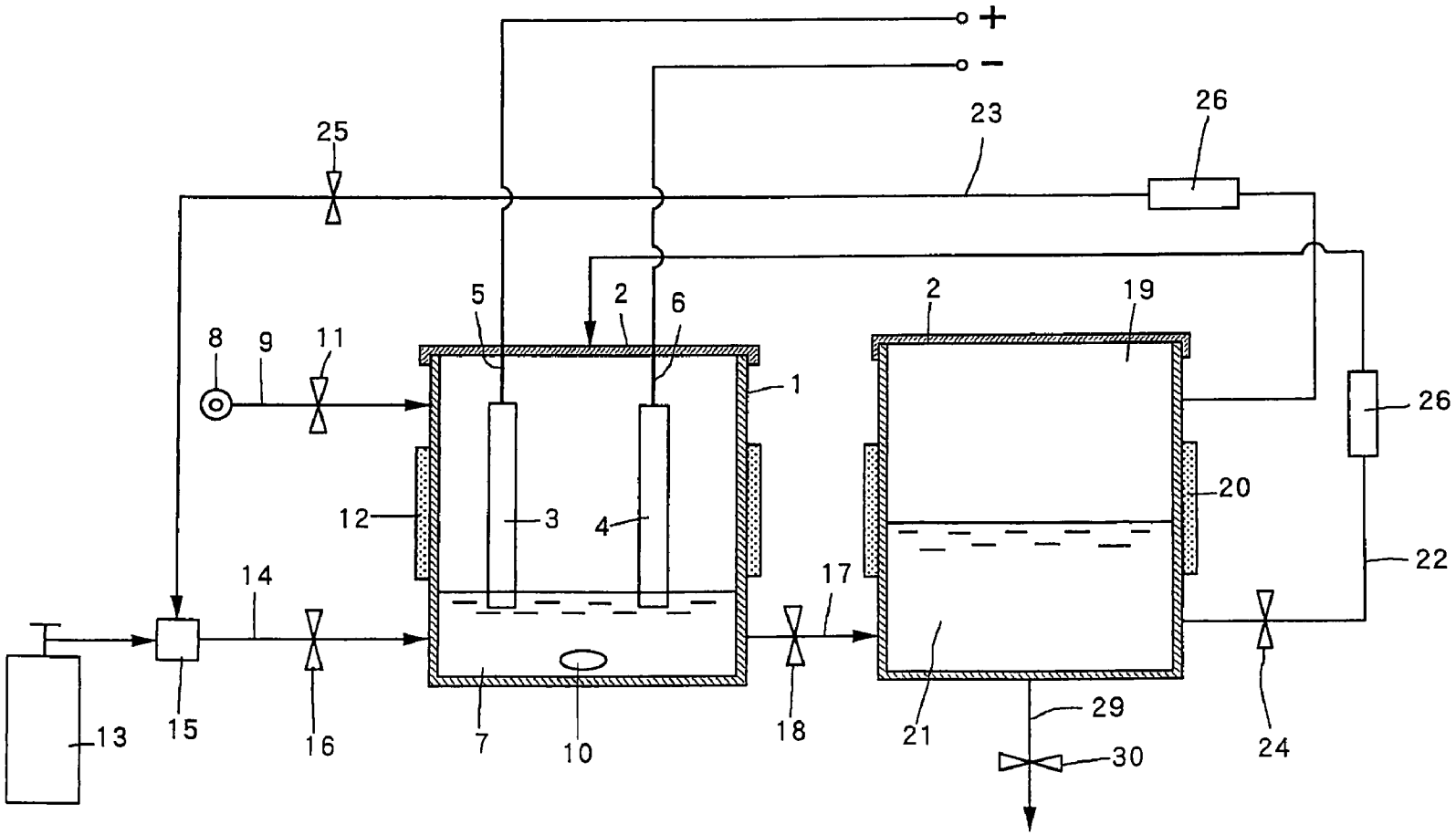
FIG. 3 is an explanatory view showing a third embodiment of the present invention in which a supercritical carbon dioxide is introduced into a pressure resisting and hermetically closed electrolytic vessel and dissolved in water so as to be subjected to anodic oxidation treatment.

FIGS. 2 and 3 show other embodiments of the present invention, in which the components corresponding to those of the above-mentioned embodiment are denoted by same reference numeral.

Of those FIGURES, FIG. 2 show the second embodiment of the present invention. In this second embodiment, an electrolytic solution generating device 31 is installed on the outer side of the electrolytic vessel 1. This device 31 is connected with the gas conduit 14 and the feed water pipe 9. In the electrolytic solution generating device 31, the carbon dioxide and water introduced therein are reacted so that a carbonated water as an electrolytic solution is generated. The carbonated water thus generated is supplied into the electrolytic vessel 1 through the conduit 33.

In the illustration, reference numeral 34 denotes a stop valve which is inserted in the conduit 33, and reference numeral 35 denotes an air discharge valve which is attached to the cover member 2. This air discharge valve 35 is opened by detecting operation of a liquid surface sensor 36 which is disposed at an upper part of the electrolytic vessel 1, so that the carbon dioxide stayed between the electrolytic solution 32 and the cover member 2 is discharged to the outside and the electrolytic solution 32 is prevented from overflowing.

That is, a carbonated water as an electrolytic solution is generated by the external electrolytic solution generating device 31, and the carbonated water thus generated is supplied into the electrolytic vessel 1. Owing to this arrangement, the carbonated water can easily be made, the carbonated water generating equipment can be made compact and reduced in cost.

The cover member 2 is formed like bellows which can be bent, expanded and contracted. The entire opening part of the electrolytic vessel 1 only excluding a part thereof is closed with the cover member 2 and its distal end part is embedded in the electrolytic solution 3 thereby closing the most part of the opening part of the electrolytic vessel 1.

At the time of generation of the anodic oxide film, the electrolytic vessel 1 is, as shown in FIG. 2, made in a semi-closed state, so that the carbon dioxide staying between the electrolytic solution 32 and the cover member 2 can be prevented from overflowing as much as possible. The carbon dioxide staying for a predetermined time or longer, is discharged by the air discharge valve 35. Thus, safety of operation can be achieved and the electrolytic solution 32 can be prevented from overflowing.

In this case, the carbon dioxide staying at an upper part of the electrolytic vessel 1 is returned into the electrolytic solution generating device 31. By doing so, effective utilization can be achieved.

The carbon dioxide is fed directly into the electrolytic vessel 1 separately from the gas conduit 14. Owing to this arrangement, the acid concentration of the electrolytic vessel 32 can be maintained constant.

FIG. 3 shows the third embodiment of the present invention, in which the electrolytic vessel 1 and the storage tank 19 are formed in a pressure-resisting structure which can be hermetically closed. Carbon dioxide is introduced into the electrolytic vessel 1 independently or at the same time. The carbon dioxide thus introduced into the vessel 1 can be formed in a supercritical state.

In the storage tank 19, the treatment fluid contained in the electrolytic vessel 1 is primarily stored therein, the treatment fluid is separated into air and liquid for reproduction, and the water and carbon dioxide thus reproduced are returned into the electrolytic vessel 1 and the compression pump 15, so that they can be re-utilized.

The object 3, which is not yet subjected to the degreasing treatment, is received in the electrolytic vessel 1, carbon dioxide is introduced into the electrolytic vessel 1 after the vessel 1 is hermetically closed, and the carbon dioxide is then formed in a supercritical state, i.e., 7.4 MPa and 31 degrees C. or higher, through the compression pump 15 and the heater 12, so that the object 3 can be degreased and cleaned.

After the degreasing and cleaning treatment, the stop valve 18 is opened to feed the cleaned carbon dioxide into the storage tank 19. After the stop valve 18 is closed, a predetermined quantity of water 7 and carbon dioxide is introduced into the electrolytic vessel 1 and dissolved to generate a carbonated water. A predetermined surface active agent is then added to the carbonated water to form an emulsion state of a supercritical carbon dioxide.

In this case, since the inside of the electrolytic vessel 1 is in a state of high pressure, the dissolving degree of the carbon dioxide with respect to the water 7 can be increased to that extent, and the acid concentration of the carbonated water can be increased.

Then, the agitator 10 is actuated to agitate the electrolytic solution to generate a large amount of fine air bubble in the electrolytic solution, and a positive current is supplied to the object 3, so that the degreased object 3 is oxidatively reacted with the electrolytic solution to thereby generate an anodic oxide film of amorphous alumina ($Al_2O_3$) on the base surface of the object 3.

After the treatment is carried out for a predetermined time, the supply of electric current is stopped and the stop valve 18 is opened to feed the water 7 and the carbon dioxide in an air-liquid two-layer state into the storage tank 19.

At that time, a predetermined flow is generated in the system of the electrolytic vessel 1. This serves to clean the object 3 and also enhance the drying of the object 3. Thus, the washing treatment in water after the anodic oxidation treatment, as required in the conventional method, can be eliminated.

The inventors of the present invention tried to put color on the anodic oxide film thus generated. The result was that the color cannot be put on the anodic oxidation film.

The reasons for the above can be considered as follows. Since the inside of the electrolytic vessel 1 is held in such a high pressure state as 7.4 MPa at the time of generation of an anodic oxide film, the hole sealing treatment is conducted simultaneously with the generation of the anodic oxide film and the holes formed in the bulk layer of the anodic oxide film are blocked.

When the anodic oxide film is generated under the supercritical carbon dioxide, the hole sealing treatment is conducted simultaneously. Accordingly, it is no more required to perform such a troublesome work to form a hole sealing treatment layer and to shift the object 3 to the hole sealing treatment layer, which is conventionally required. Thus, the equipment cost can be reduced, the equipment can be made compact and productivity can be enhanced.

In any one of the above-mentioned embodiments, the present invention is applied to generation of an anodic oxide film. However, the present invention is not limited to this. Instead, the invention can likewise be applied to the electropolishing which is substantially based on the same principle as the anodic oxidation method.

INDUSTRIAL APPLICABILITY

As apparent from the description made hereinbefore, an anodic oxidation method and a treatment apparatus thereof according to the present invention is capable of generating an oxide film at a low cost and rapidly by eliminating the use of electrolytic solution having a strong acid property and using a carbonated water as the electrolytic solution, capable of improving the oxide film generating operation and rationalizing the water discharging treatment, capable of preventing increase in temperature of the electrolytic solution without a need of a special equipment, capable of generating an oxide film in a stable manner and obtaining a good oxide film by eliminating the generation of oxide in the vicinity of an object to be treated, and capable of rationalization of the oxide film generating treatment and enhancing the productivity by using supercritical carbon dioxide, and suitable, for example, for generation of an oxide film and electropolishing of aluminum.

The invention claimed is:

1. A method of forming an oxide film on a surface of an object by electrolysis in which the object is an anode immersed in an electrolytic solution, comprising forming the electrolytic solution by dissolving carbon dioxide under pressure in water thereby to form a carbonated water of predetermined acid concentration to which no strong acid is added and applying current to the electrolytic solution thereby to form an oxide film on the object.

2. A method according to claim 1, wherein the pressure of the carbon dioxide is at least atmospheric.

3. A method according to claim 1, wherein the carbon dioxide is supercritical.

4. A method according to claim 1, further comprising adding a surface active agent to the electrolytic solution thereby to form an emulsion of the carbon dioxide.

5. A method according to claim 1, further comprising degreasing said object before or during the forming of the oxide film thereon.

6. A method according to claim 1, wherein any holes in the oxide film are sealed by the electrolytic formation of the oxide film without a separate hole sealing treatment.

7. A method according to claim 1, further comprising conducting the formation of the oxide film while the electrolytic solution is under pressure and, after the formation of the oxide film, reducing the pressure of the electrolytic solution thereby to decrease the acid concentration thereof and discharging the electrolytic solution of reduced acid concentration.

8. A method according to claim 1, further comprising conducting the formation of the oxide film while the electrolytic solution is under pressure and, after the formation of the oxide film, heating and reducing pressure on the electrolytic solution thereby to separate the carbon dioxide from the water for subsequent discharge or reuse.

9. A method according to claim 1, wherein the acid concentration is pH 3 to 4.

10. A method according to claim 1, wherein the object is an aluminum or aluminum alloy object.

* * * * *